US008844069B1

(12) United States Patent
Harvey

(10) Patent No.: US 8,844,069 B1
(45) Date of Patent: Sep. 30, 2014

(54) INFLATABLE TANK AND BASIN SYSTEM

(76) Inventor: Margaret W. Harvey, Elkhart, IN (US)

( * ) Notice: Subject to any disclaimer, the term of this patent is extended or adjusted under 35 U.S.C. 154(b) by 370 days.

(21) Appl. No.: 13/467,973

(22) Filed: May 9, 2012

(51) Int. Cl.
*A47K 1/00* (2006.01)

(52) U.S. Cl.
USPC ..... 4/625

(58) Field of Classification Search
USPC ..... 6/625
See application file for complete search history.

(56) References Cited

U.S. PATENT DOCUMENTS

D293,364 S 12/1987 Everard
5,313,676 A 5/1994 Wright
5,530,973 A 7/1996 Dodge
5,813,063 A 9/1998 Watkins et al.
6,161,228 A 12/2000 Wietecha
7,441,286 B1 * 10/2008 Taylor Parker ..... 4/625
7,743,439 B2 6/2010 Switzer
8,082,611 B1 * 12/2011 Marshall ..... 4/625

* cited by examiner

*Primary Examiner* — Huyen Le

(57) ABSTRACT

An inflatable tank and basin system for providing water for sanitation has a tank constructed from a pliable material with a tank sealed cavity for inflation. In a first state, upon inflation, the tank is for containing water. In a second state, upon deflation, the tank is collapsible for easy portability. The system has a basin with a concave basin top. The basin is constructed from a pliable material with a basin sealed cavity for inflation. In a first state, upon inflation, the basin is for containing water. In a second state, upon deflation, the basin is collapsible for easy portability. The inflatable tank and basin system is for providing water for sanitation in areas wherein there is no present or there is limited/remote access like in parks and disaster shelters.

11 Claims, 8 Drawing Sheets

INFLATABLE TANK AND BASIN SYSTEM

BACKGROUND OF THE INVENTION

Sanitary wash systems have been used for general cleansing and for disease control for many years. Typically, a water source is connected to a faucet for volume control that is located over a basin or a sink to contain the water that is used. Sometimes, a potable water container can be used in lieu of water source and faucet. Other times, a basin may not be present to catch and contain the water used, leaving a messy area. The present invention teaches an inflatable tank and basin system for providing water for sanitation in an area with no present or there is limited/remote access like in parks and disaster shelters.

SUMMARY

The present invention features an inflatable tank and basin system for providing water for sanitation. In some embodiments, the system comprises a tank constructed from a pliable material having a tank sealed cavity for inflation. In some embodiments, in a first state, upon inflation, the tank is for containing water. In some embodiments, in a second state, upon deflation, the tank is collapsible for easy portability.

In some embodiments, the system comprises a basin having a concave basin top. In some embodiments, the basin is constructed from a pliable material having a basin sealed cavity for inflation. In some embodiments, in a first state, upon inflation, the basin is for containing water. In some embodiments, in a second state, upon deflation, the basin is collapsible for easy portability.

In some embodiments, water can enter the tank via a tank inlet port. In some embodiments, water can be removed from the tank via a tank outlet port. In some embodiments, water can enter the basin via a basin inlet port. In some embodiments, water can be removed from the basin cavity via a basin outlet port.

In some embodiments, the inflatable tank and basin system is for providing water for sanitation in areas where there is no present or there is limited/remote access like in parks and disaster shelters.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
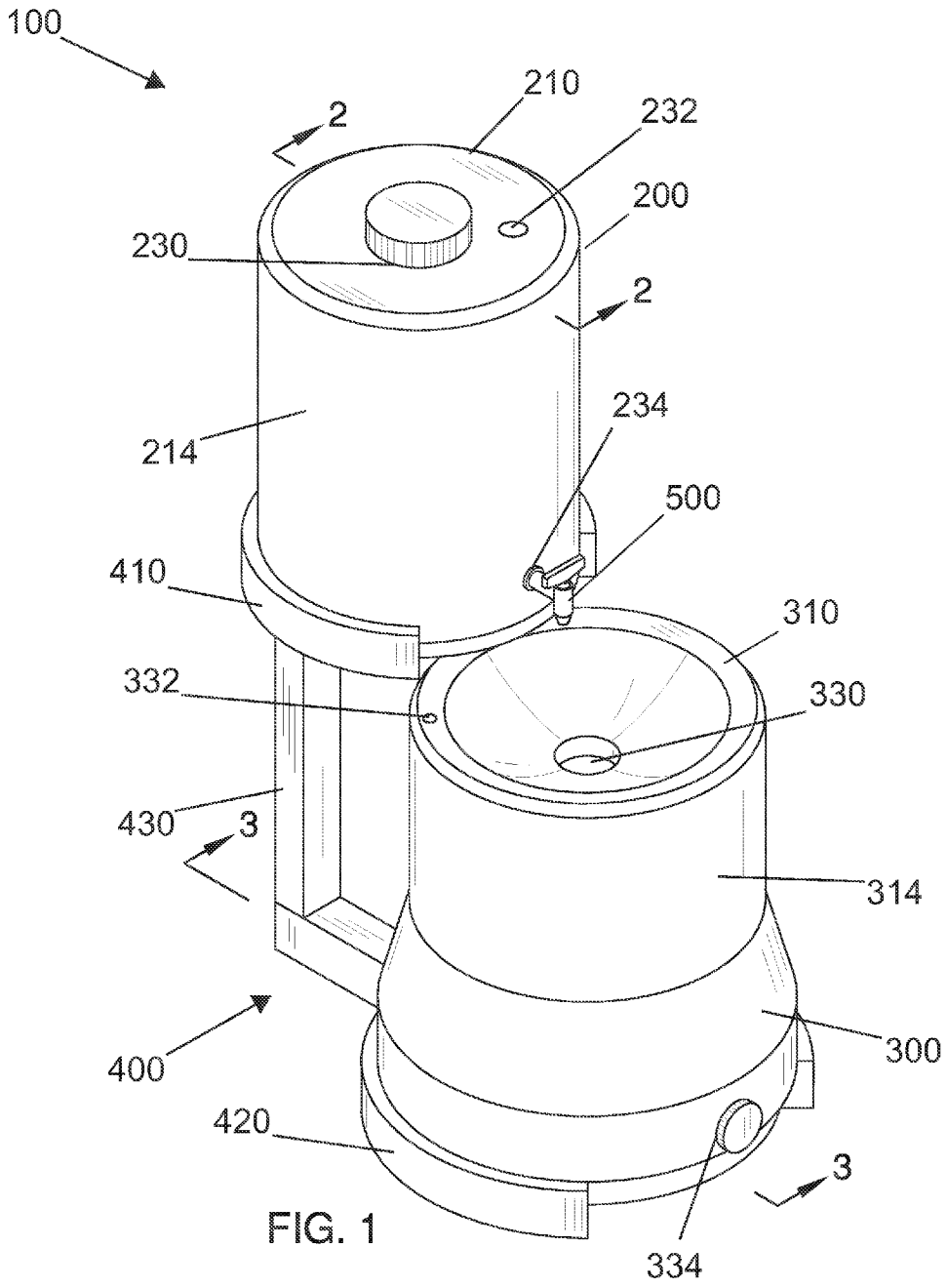
FIG. 1 is a perspective view of the present invention.
Figure 2:
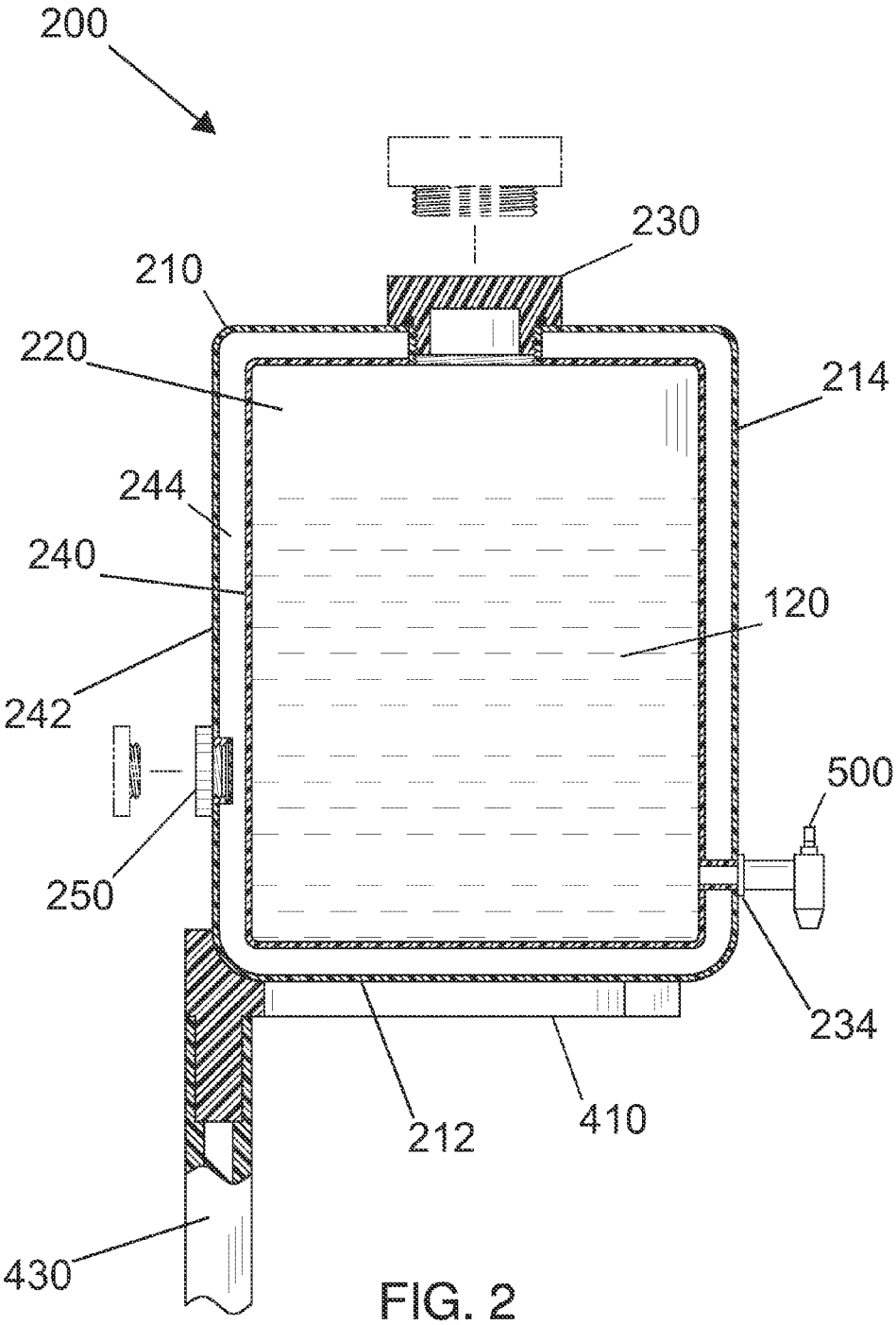
FIG. 2 is a cross-sectional view in a coronal plane of the tank of the present invention.
Figure 3:
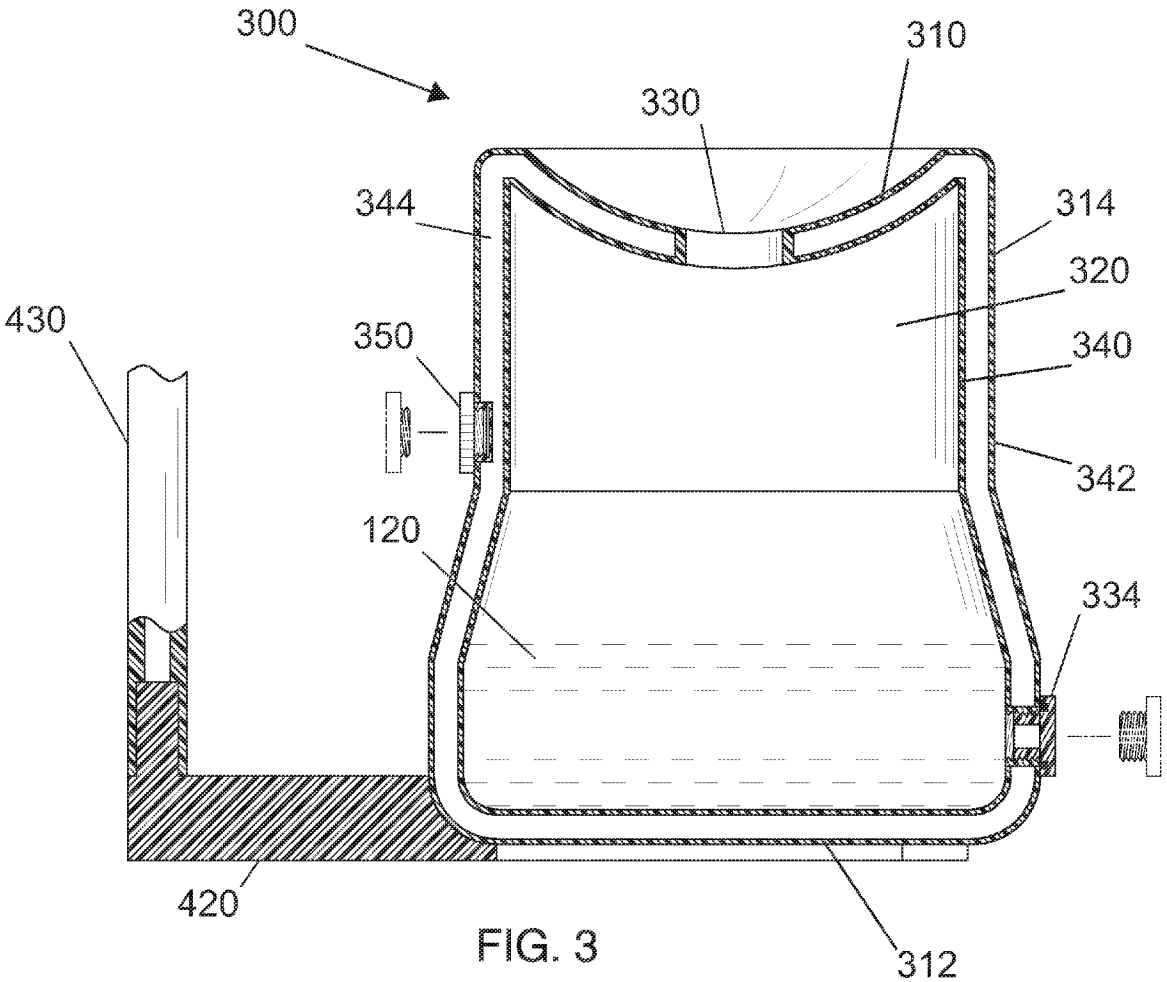
FIG. 3 is a cross-sectional view in a coronal plane of the basin of the present invention.
Figure 4:
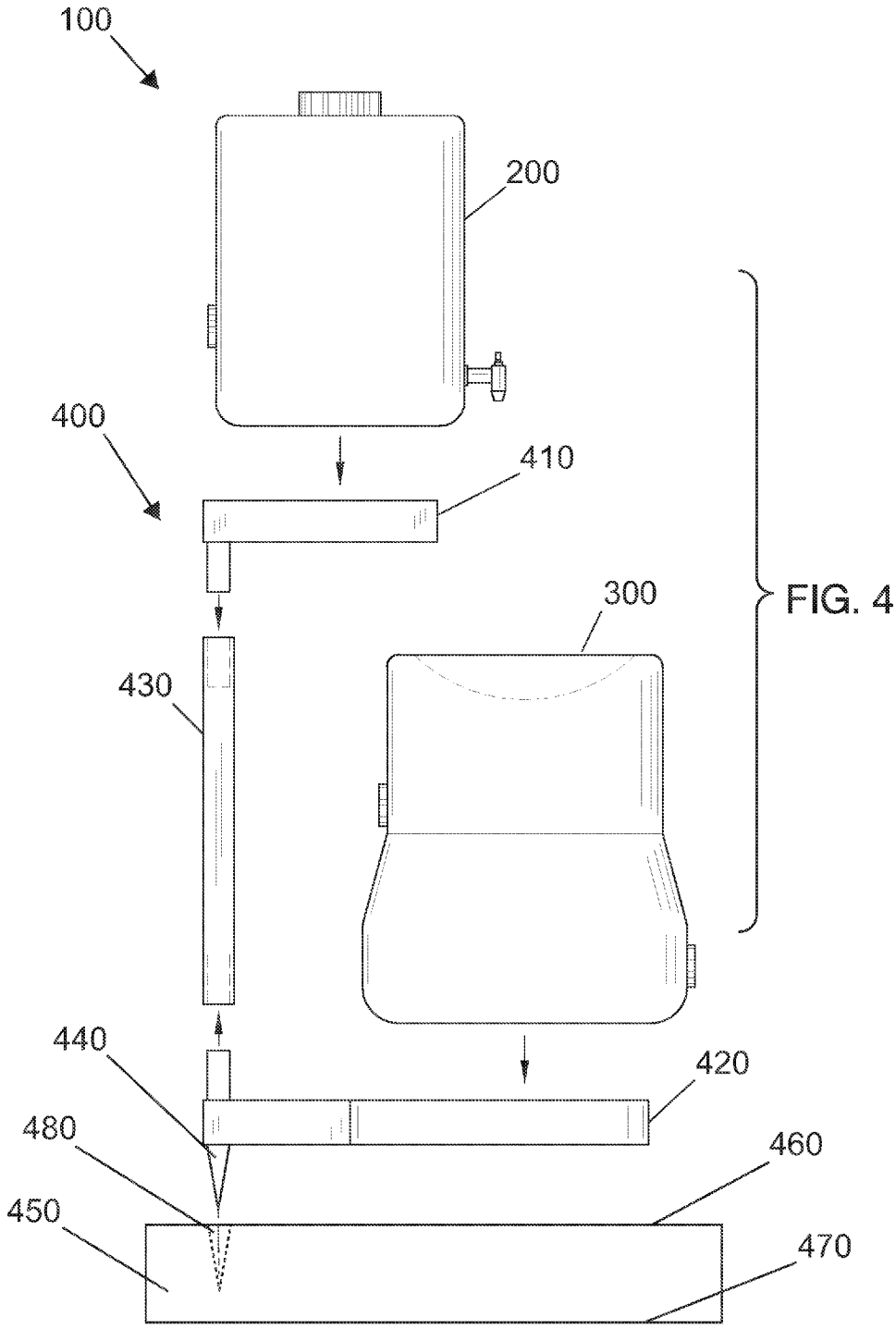
FIG. 4 is a side view of the present invention.
Figure 5:
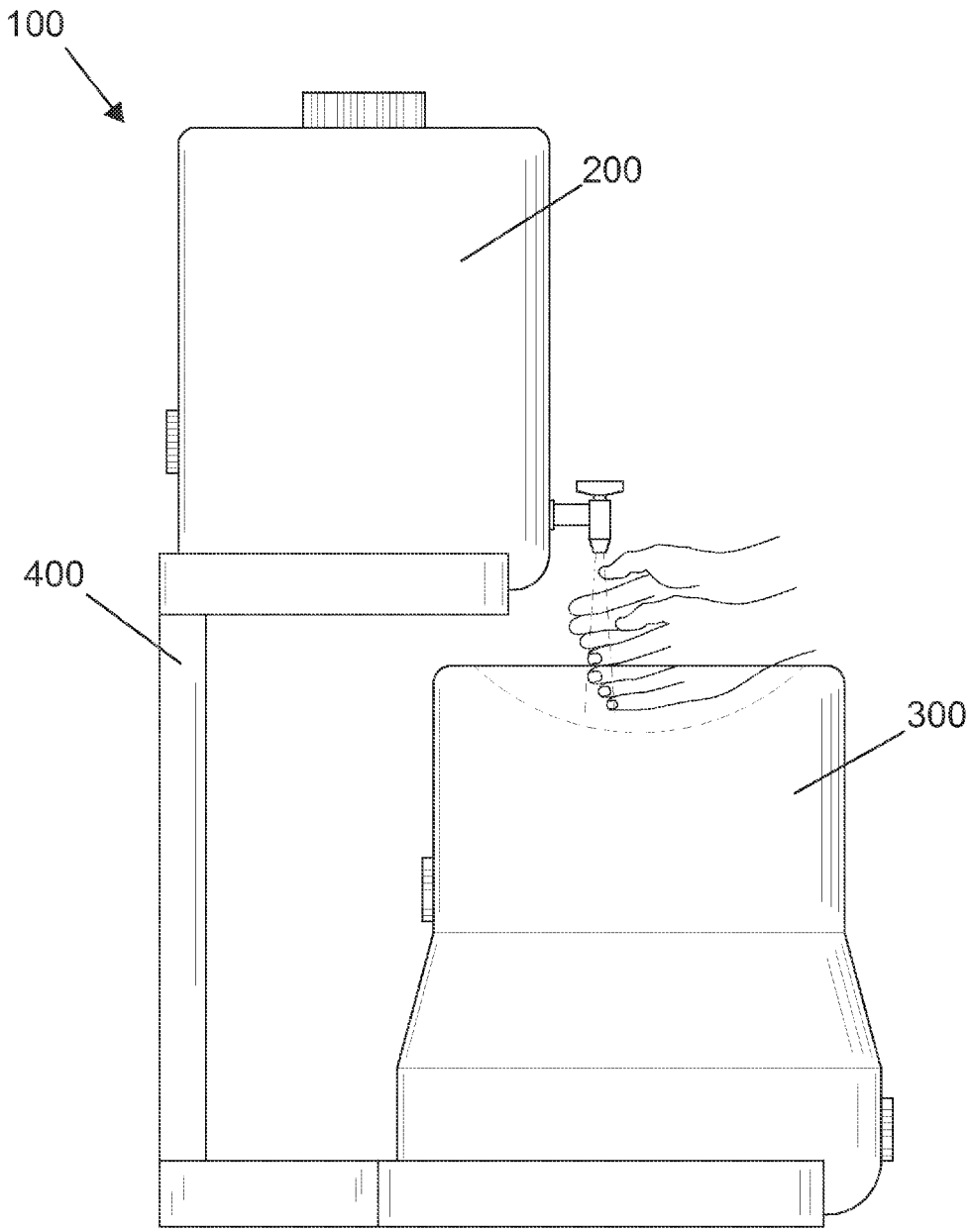
FIG. 5 is a side view of the present invention.
Figure 6:
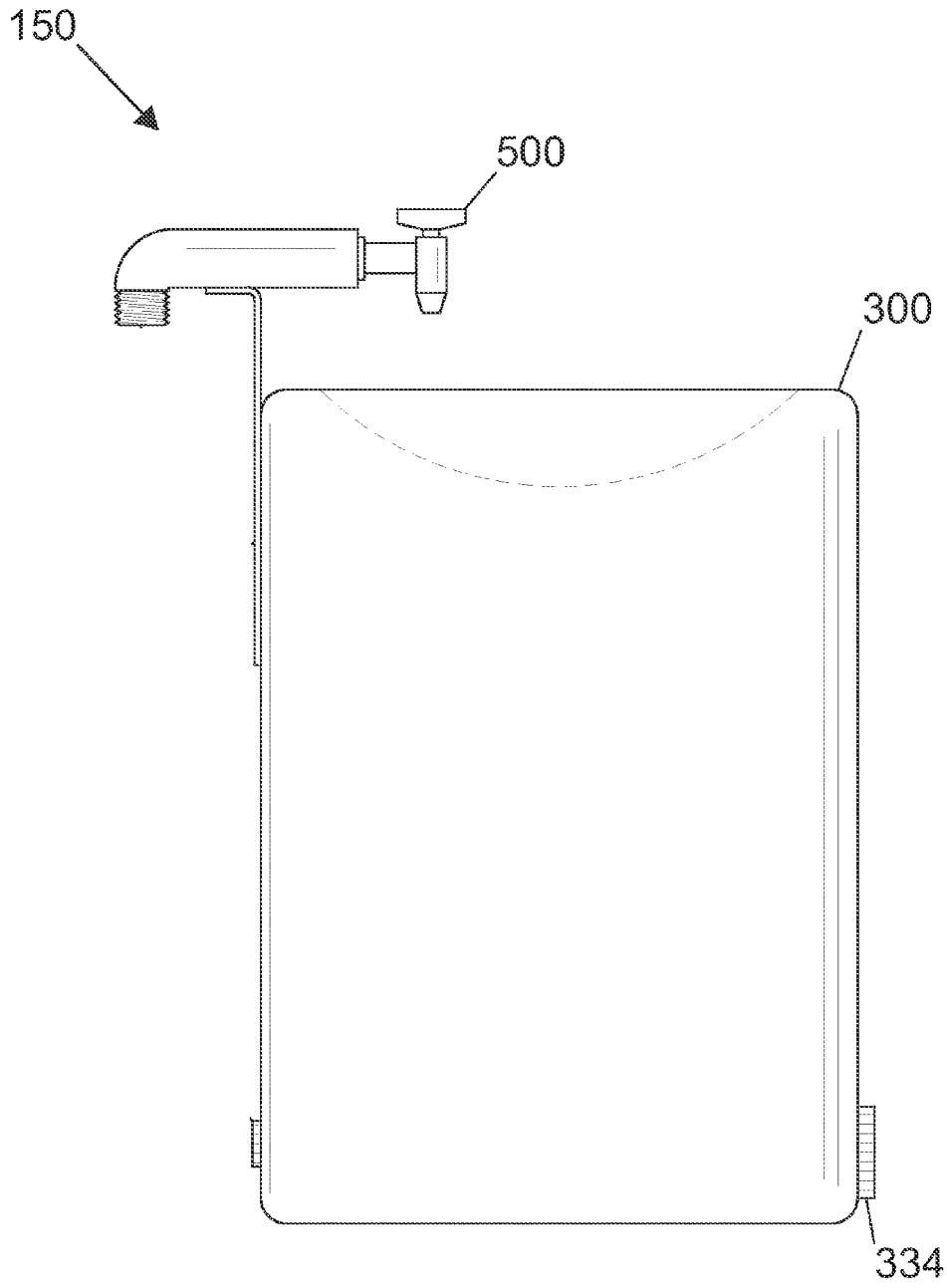
FIG. 6 is a side view of an alternate embodiment of the present invention.
Figure 7:
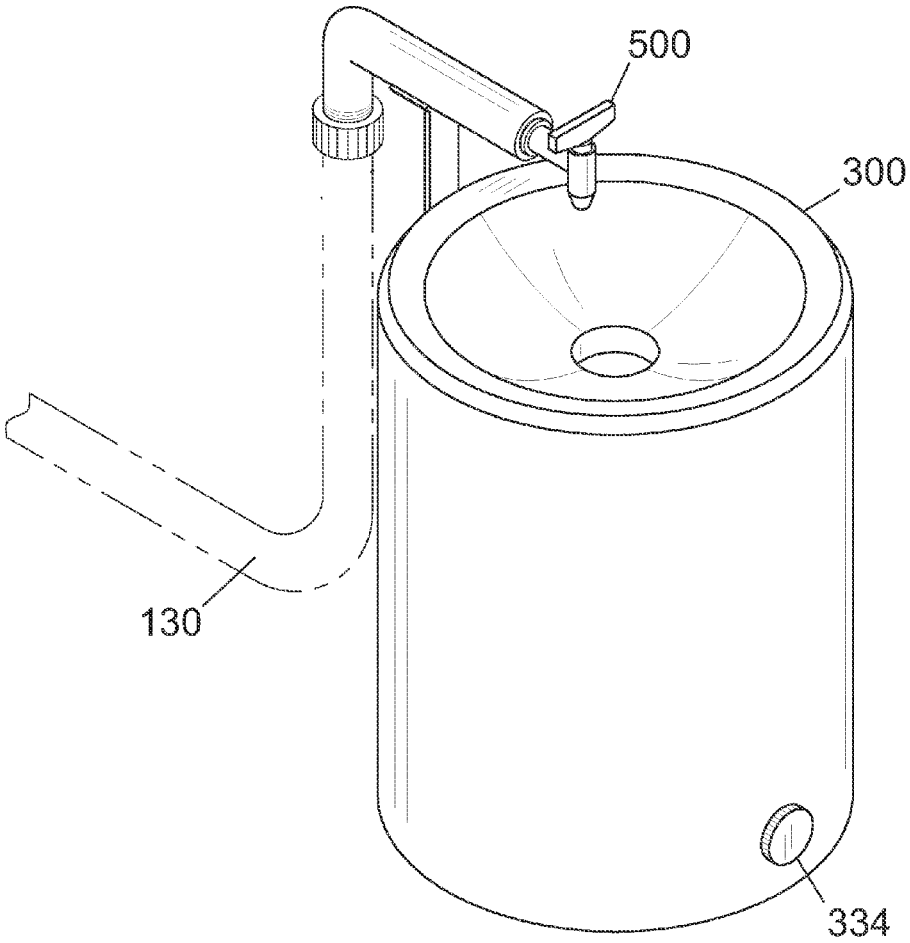
FIG. 7 is a perspective view of an alternate embodiment of the present invention.
Figure 8:
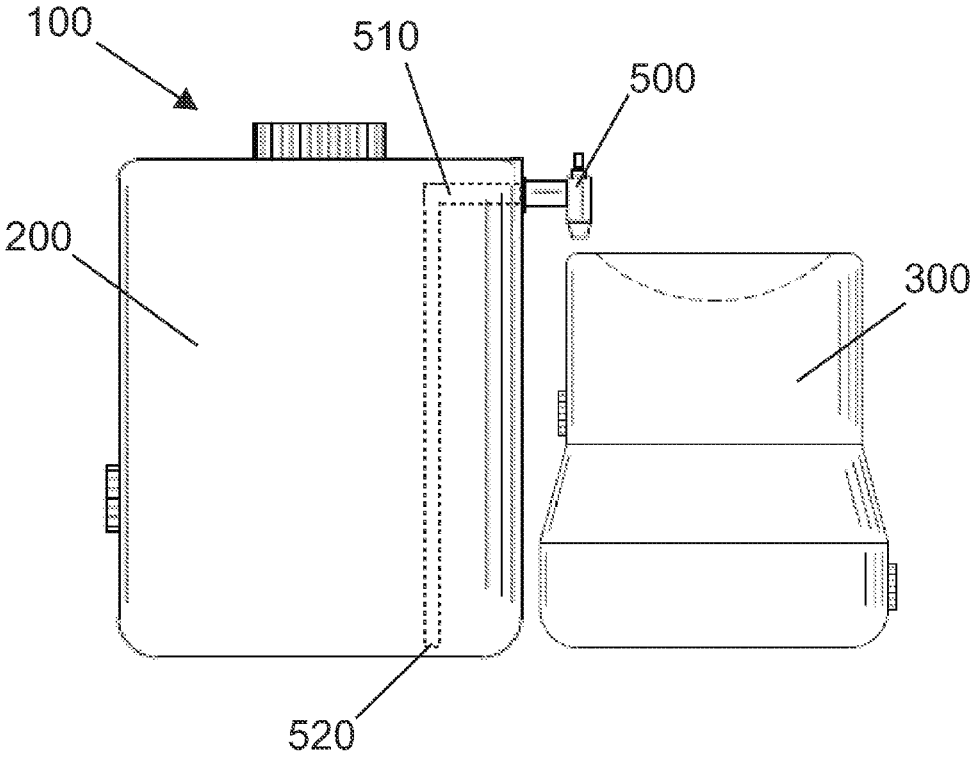
FIG. 8 is a side view of an alternate embodiment of the present invention.

Following is a list of elements corresponding to a particular element referred to herein:

100 Tank and basin system
120 Water
130 Potable water source
150 Basin system
200 Tank
210 Tank top
212 Tank bottom
214 Tank side wall
220 Tank cavity
230 Tank inlet port
232 Tank vent port
234 Tank outlet port
240 Tank inner wall
242 Tank outer wall
244 Tank sealed cavity
250 Tank air port
300 Basin
310 Basin top
312 Basin bottom
314 Basin side wall
320 Basin cavity
330 Basin inlet port
332 Basin vent port
334 Basin outlet port
340 Basin inner wall
342 Basin outer wall
344 Basin sealed cavity
350 Basin air port
400 Stand
410 Stand top support member
420 Stand base support member
430 Stand extension support member
440 Stake
450 Base component
460 Top base surface
470 Bottom base surface
480 Recess
500 Spigot
510 Tube
520 Tube inlet aperture Referring now to FIG. 1-8, the present invention features an inflatable tank and basin system (100) for providing water (120) for sanitation. In some embodiments, the system (100) comprises a tank (200) having a tank top (210), a tank bottom (212), a tank side wall (214), and a tank cavity (220) located inside.

In some embodiments, the tank (200) further comprises a tank inlet port (230) located on the tank top (210), a tank vent port (232) located on the tank top (210), and a tank outlet port (234) located close to the tank bottom (212) on the tank side wall (214). In some embodiments, a spigot is located in the tank outlet port (234).

In some embodiments, the tank (200) is constructed from a pliable material having a tank inner wall (240), a tank outer wall (242), and a tank sealed cavity (244) located between the tank inner wall (240) and the tank outer wall (242). In some embodiments, the tank sealed cavity (244) is for inflation. In some embodiments, the tank (200) further comprises a tank air port (250) located on the tank outer wall (242) for inflation. In some embodiments, the tank air port (250) is fluidly connected to the tank sealed cavity (244).

In some embodiments, in a first state, upon inflation, the tank (200) is for containing water (120). In some embodiments, in a second state, upon deflation, the tank (200) is collapsible for easy portability.

In some embodiments, the system (100) comprises a basin (300) having a concave basin top (310), a basin bottom (312), a basin side wall (314), and a basin cavity (320) located inside.

In some embodiments; the basin (300) further comprises a basin inlet port (330) located at a lowest point on the concave basin top (310), a basin vent port (332) located on the basin top (310), and a basin outlet port (334) located close to the basin bottom (312) on the basin side wall (314). In some embodiments, a spigot is located in the basin outlet port (334).

In some embodiments, the basin (300) is constructed from a pliable material having a basin inner wall (340), a basin outer wall (342), and a basin sealed cavity (344) located between the basin inner wall (340) and the basin outer wall (342). In some embodiments, the basin sealed cavity (344) is for inflation. In some embodiments, the basin (300) further comprises a basin air port (350) located on the basin outer wall (342) for inflation. In some embodiments, the basin air port (350) is fluidly connected to the basin sealed cavity (344).

In some embodiments, in a first state, upon inflation, the basin (300) is for containing water (120). In some embodiments, in a second state, upon deflation, the basin (300) is collapsible for easy portability.

In some embodiments, water (120) can enter the tank (200) via the tank inlet port (230). In some embodiments, water (120) can be removed from the tank (200) via the tank outlet port (234). In some embodiments, water (120) can enter the basin (300) via the basin inlet port (330). In some embodiments, water (120) can be removed from the basin cavity (320) via the basin outlet port (334).

In some embodiments, the inflatable tank and basin system (100) is for providing water (120) for sanitation in areas where there is no present or there is limited/remote access like in parks and disaster shelters.

In some embodiments, the system (100) comprises a stand (400) having a stand top support member (410) for placement of the tank (200), a stand base support member (420) for placing on a ground surface, and a stand extension support member (430) for structurally connecting the stand top support member (410) and the stand base support member (420). In some embodiments, the stand (400) can be disassembled for storage or portability. In some embodiments, the stand (400) is collapsible.

In some embodiments, the system (100) comprises a tapered stake (440) located on and projecting from a bottom surface of the stand base support for inserting into the ground surface.

In some embodiments, the system (100) comprises a generally planar base component (450) having a top base surface (460) and a bottom base surface (470). In some embodiments, the top base surface (460) comprises a recess (480) for receiving the stake (440). In some embodiments, the base component (450) is for placing on the ground surface.

In some embodiments, the tank (200) is located generally parallel to the basin (300). In some embodiments, the tank cavity (220) comprises a positive pressure with respect to atmospheric pressure via adding air through the tank vent port (232). In some embodiments, a tank outlet port (234) is located close to the tank top (210) on the tank side wall (214). In some embodiments, a spigot (500) is located in the tank outlet port (234). In some embodiments, the spigot (500) comprises a tube (510) fluidly connected thereto located inside the tank cavity (220). In some embodiments, a tube inlet aperture (520) is located on a distal end of the tube (510) in the tank cavity (220) close to the tank bottom (212). In some embodiments, water (120) under positive pressure can be removed from the tank (200) via the tube (510), via the spigot (500), via the tank outlet port (234).

In some embodiments, a tank and basin system (100) for providing water (120) for sanitation comprises a tank (200) having a tank top (210), a tank bottom (212), a tank side wall (214), and a tank cavity (220) located inside.

In some embodiments, the tank (200) further comprises a tank inlet port (230) located on the tank top (210), a tank vent port (232) located on the tank top (210), and a tank outlet port (234) located close to the tank bottom (212) on the tank side wall (214).

In some embodiments, the tank (200) is constructed from a pliable material. In some embodiments, the tank top (210) comprises a tank inner wall (240), a tank outer wall (242), and a tank sealed cavity (244) located between the tank inner wall (240) and the tank outer wall (242). In some embodiments, the tank sealed cavity (244) is for inflation. In some embodiments, the tank (200) further comprises a tank air port (250) located on the tank top (210) for inflation. In some embodiments, the tank air port (250), is fluidly connected to the tank sealed cavity (244).

In some embodiments, the tank bottom (212) and the tank side wall (214) are non-inflatable.

In some embodiments, in a first state, upon inflation, the tank (200) is for containing water (120). In some embodiments, in a second state, upon deflation, the tank (200) is collapsible for easy portability.

In some embodiments, the system (100) comprises a basin (300) having a concave basin top (310), a basin bottom (312), a basin side wall (314), and a basin cavity (320) located inside.

In some embodiments, the basin (300) further comprises a basin inlet port (330) located at a lowest point on the concave basin top (310), and a basin outlet port (334) located close to the basin bottom (312) on the basin side wall (314).

In some embodiments, the basin (300) is constructed from a pliable material. In some embodiments, the basin top (310) comprises a basin inner wall (340), a basin outer wall (342), and a basin sealed cavity (344) located between the basin inner wall (340) and the basin outer wall (342). In some embodiments, the basin sealed cavity (344) is for inflation. In some embodiments, the basin (300) further comprises a basin air port (350) located on the basin top (310) for inflation. In some embodiments, the basin air port (350) is fluidly connected to the basin sealed cavity (344).

In some embodiments, the basin bottom (312) and the basin side wall (314) are non-inflatable.

In some embodiments, in a first state, upon inflation, the basin (300) is for containing water (120). In some embodiments, in a second state, upon deflation, the basin (300) is collapsible for easy portability.

In some embodiments, water (120) can enter the tank (200) via the tank inlet port (230). In some embodiments, water (120) can be removed from the tank (200) via the tank outlet port (234). In some embodiments, water (120) can enter the basin (300) via the basin inlet port (330). In some embodiments, water (120) can be removed from the basin cavity (320) via the basin outlet port (334).

In some embodiments, the inflatable tank and basin system (100) is for providing water (120) for sanitation in areas where there is no present or there is limited/remote access like in parks and disaster shelters.

In some embodiments, the system (100) comprises a stand (400) having a stand top support member (410) for placement of the tank (200), a stand base support member (420) for placing on a ground surface, and a stand extension support member (430) for structurally connecting the stand top support member (410) and the stand base support member (420).

In some embodiments, the system (100) comprises a tapered stake (440) located on and projecting from a bottom surface of the stand base support for inserting into the ground surface.

In some embodiments, the system (100) comprises a generally planar base component (450) having a top base surface (460) and a bottom base surface (470). In some embodiments, the top base surface (460) comprises a recess (480) for receiving the stake (440). In some embodiments, the base component (450) is for placing on the ground surface.

In some embodiments, the tank (200) is located generally parallel to the basin (300). In some embodiments, the tank cavity (220) comprises a positive pressure with respect to atmospheric pressure via adding air through the tank vent port (232). In some embodiments, a tank outlet port (234) is located close to the tank top (210) on the tank side wall (214). In some embodiments, a spigot (500) is located in the tank outlet port (234). In some embodiments, the spigot (500) comprises a tube (510) fluidly connected thereto located inside the tank cavity (220). In some embodiments, a tube inlet aperture (520) is located on a distal end of the tube (510) in the tank cavity (220) close to the tank bottom (212). In some embodiments, water (120) under positive pressure can be removed from the tank (200) via the tube (510), via the spigot (500), via the tank outlet port (234).

In some embodiments, an inflatable basin system (150) for providing water (120) for sanitation comprises a spigot (500) fluidly connected to a potable water source (130).

In some embodiments, the system (100) comprises a basin (300) having a concave basin top (310), a basin bottom (312), a basin side wall (314), and a basin cavity (320) located inside.

In some embodiments, the basin (300) further comprises a basin inlet port (330) located at a lowest point on the concave basin top (310), and a basin outlet port (334) located close to the basin bottom (312) on the basin side wall (314).

In some embodiments, the basin (300) is constructed from a pliable material having a basin inner wall (340), a basin outer wall (342), and a basin sealed cavity (344) located between the basin inner wall (340) and the basin outer wall (342). In some embodiments, the basin sealed cavity (344) is for inflation. In some embodiments, the basin (300) further comprises a basin air port (350) located on the basin outer wall (342) for inflation. In some embodiments, the basin air port (350) is fluidly connected to the basin sealed cavity (344).

In some embodiments, in a first state, upon inflation, the basin (300) is for containing water (120). In some embodiments, in a second state, upon deflation, the basin (300) is collapsible for easy portability.

In some embodiments, the spigot (500) is located on the basin top (310) for dispensing water (120).

In some embodiments, water (120) can enter the basin (300) via the basin inlet port (330). In some embodiments, water (120) can be removed from the basin cavity (320) via the basin outlet port (334).

In some embodiments, the inflatable basin system (150) is for providing water (120) for sanitation in areas where there is no present or there is limited/remote access like in parks and disaster shelters.

As used herein, the term "about" refers to plus or minus 10% of the referenced number. For example, an embodiment wherein the tank is about 10 inches in length includes a tank that is between 9 and 11 inches in length.

The disclosures of the following U.S. Patents are incorporated in their entirety by reference herein: U.S. Pat. No. D 293,364; U.S. Pat. No. 7,743,439; U.S. Pat. No. 6,161,228; U.S. Pat. No. 5,813,063; U.S. Pat. No. 5,530,973; U.S. Pat. No. 5,313,676.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An inflatable tank and basin system (100) for providing water (120) for sanitation, wherein said system (100) comprises:

(a) a tank (200) having a tank top (210), a tank bottom (212), a tank side wall (214), and a tank cavity (220) disposed therein, wherein the tank (200) further comprises a tank inlet port (230) disposed on the tank top (210), a tank vent port (232) disposed on the tank top (210), and a tank outlet port (234) disposed proximal to the tank bottom (212) on the tank side wall (214), wherein the tank (200) is constructed from a pliable material having a tank inner wall (240), a tank outer wall (242), and a tank sealed cavity (244) disposed between the tank inner wall (240) and the tank outer wall (242), wherein the tank sealed cavity (244) is for inflation, wherein the tank (200) further comprises a tank air port (250) disposed on the tank outer wall (242) for inflation, wherein the tank air port (250) is fluidly connected to the tank sealed cavity (244), wherein in a first state, upon inflation, the tank (200) is for containing water (120), wherein in a second state, upon deflation, the tank (200) is collapsible for easy portability; and (b) a basin (300) having a concave basin top (310), a basin bottom (312), a basin side wall (314), and a basin cavity (320) disposed therein, wherein the basin (300) further comprises a basin inlet port (330) disposed at a lowest point on the concave basin top (310), a basin vent port (332) disposed on the basin top (310), and a basin outlet port (334) disposed proximal to the basin bottom (312) on the basin side wall (314), wherein the basin (300) is constructed from a pliable material having a basin inner wall (340), a basin outer wall (342), and a basin sealed cavity (344) disposed between the basin inner wall (340) and the basin outer wall (342), wherein the basin sealed cavity (344) is for inflation, wherein the basin (300) further comprises a basin air port (350) disposed on the basin outer wall (342) for inflation, wherein the basin air port (350) is fluidly connected to the basin sealed cavity (344), wherein in a first state, upon inflation, the basin (300) is for containing water (120), wherein in a second state, upon deflation, the basin (300) is collapsible for easy portability, wherein water (120) can enter the tank (200) via the tank inlet port (230), wherein water (120) can be removed from the tank (200) via the tank outlet port (234), wherein water (120) can enter the basin (300) via the basin inlet port (330), wherein water (120) can be removed from the basin cavity (320) via the basin outlet port (334), wherein the inflatable tank and basin system (100) is for providing water (120) for sanitation in areas wherein there is no present or there is limited/remote access like in parks and disaster shelters.

2. The system (100) of claim 1, wherein the system (100) comprises a stand (400) having a stand top support member (410) for placement of the tank (200), a stand base support member (420) for placing on a ground surface, and a stand extension support member (430) for structurally connecting the stand top support member (410) and the stand base support member (420).

3. The system (100) of claim 2, wherein the system (100) comprises a tapered stake (440) disposed on and projecting from a bottom surface of the stand base support for inserting into the ground surface.

4. The system (100) of claim 3, wherein the system (100) comprises a generally planar base component (450) having a top base surface (460) and a bottom base surface (470), wherein the top base surface (460) comprises a recess (480) for receiving the stake (440), wherein the base component (450) is for placing on the ground surface.

5. The system (100) of claim 1, wherein the tank (200) is disposed generally parallel to the basin (300), wherein the tank cavity (220) comprises a positive pressure with respect to atmospheric pressure via adding air through the tank vent port (232), wherein the tank outlet port (234) is disposed proximal to the tank top (210) on the tank side wall (214), wherein a spigot (500) is disposed in the tank outlet port (234), wherein the spigot (500) comprises a tube (510) fluidly connected thereto disposed inside the tank cavity (220), wherein a tube inlet aperture (520) is disposed on a distal end of the tube (510) in the tank cavity (220) proximal to the tank bottom (212), wherein water (120) under positive pressure can be removed from the tank (200) via the tube (510), via the spigot (500), via the tank outlet port (234).

6. A tank and basin system (100) for providing water (120) for sanitation, wherein said system (100) comprises:

(a) a tank (200) having a tank top (210), a tank bottom (212), a tank side wall (214), and a tank cavity (220) disposed therein, wherein the tank (200) further comprises a tank inlet port (230) disposed on the tank top (210), a tank vent port (232) disposed on the tank top (210), and a tank outlet port (234) disposed proximal to the tank bottom (212) on the tank side wall (214), wherein the tank (200) is constructed from a pliable material, wherein the tank top (210) comprises a tank inner wall (240), a tank outer wall (242), and a tank sealed cavity (244) disposed between the tank inner wall (240) and the tank outer wall (242), wherein the tank sealed cavity (244) is for inflation, wherein the tank (200) further comprises a tank air port (250) disposed on the tank top (210) for inflation, wherein the tank air port (250) is fluidly connected to the tank sealed cavity (244), wherein the tank bottom (212) and the tank side wall (214) are non-inflatable, wherein in a first state, upon inflation, the tank (200) is for containing water (120), wherein in a second state, upon deflation, the tank (200) is collapsible for easy portability; and (b) a basin (300) having a concave basin top (310), a basin bottom (312), a basin side wall (314), and a basin cavity (320) disposed therein, wherein the basin (300) further comprises a basin inlet port (330) disposed at a lowest point on the concave basin top (310), and a basin outlet port (334) disposed proximal to the basin bottom (312) on the basin side wall (314), wherein the basin (300) is constructed from a pliable material, wherein the basin top (310) comprises a basin inner wall (340), a basin outer wall (342), and a basin sealed cavity (344) disposed between the basin inner wall (340) and the basin outer wall (342), wherein the basin sealed cavity (344) is for inflation, wherein the basin (300) further comprises a basin air port (350) disposed on the basin top (310) for inflation, wherein the basin air port (350) is fluidly connected to the basin sealed cavity (344), wherein the basin bottom (312) and the basin side wall (314) are non-inflatable, wherein in a first state, upon inflation, the basin (300) is for containing water (120), wherein in a second state, upon deflation, the basin (300) is collapsible for easy portability, wherein water (120) can enter the tank (200) via the tank inlet port (230), wherein water (120) can be removed from the tank (200) via the tank outlet port (234), wherein water (120) can enter the basin (300) via the basin inlet port (330), wherein water (120) can be removed from the basin cavity (320) via the basin outlet port (334), wherein the inflatable tank and basin system (100) is for providing water (120) for sanitation in areas wherein there is no present or there is limited/remote access like in parks and disaster shelters.

7. The system (100) of claim 6, wherein the system (100) comprises a stand (400) having a stand top support member (410) for placement of the tank (200), a stand base support member (420) for placing on a ground surface, and a stand extension support member (430) for structurally connecting the stand top support member (410) and the stand base support member (420).

8. The system (100) of claim 7, wherein the system (100) comprises a tapered stake (440) disposed on and projecting from a bottom surface of the stand base support for inserting into the ground surface.

9. The system (100) of claim 8, wherein the system (100) comprises a generally planar base component (450) having a top base surface (460) and a bottom base surface (470), wherein the top base surface (460) comprises a recess (480) for receiving the stake (440), wherein the base component (450) is for placing on the ground surface.

10. The system (100) of claim 6, wherein the tank (200) is disposed generally parallel to the basin (300), wherein the tank cavity (220) comprises a positive pressure with respect to atmospheric pressure via adding air through the tank vent port (232), wherein a tank outlet port (234) is disposed proximal to the tank top (210) on the tank side wall (214), wherein a spigot (500) is disposed in the tank outlet port (234), wherein the spigot (500) comprises a tube (510) fluidly connected thereto disposed inside the tank cavity (220), wherein a tube inlet aperture (520) is disposed on a distal end of the tube (510) in the tank cavity (220) proximal to the tank bottom (212), wherein water (120) under positive pressure can be removed from the tank (200) via the tube (510), via the spigot (500), via the tank outlet port (234).

11. An inflatable basin system (150) for providing water (120) for sanitation, wherein said system (150) comprises:

(a) a spigot (500) fluidly connected to a potable water source (130); and (b) a basin (300) having a concave basin top (310), a basin bottom (312), a basin side wall (314), and a basin cavity (320) disposed therein, wherein the basin (300) further comprises a basin inlet port (330) disposed at a lowest point on the concave basin top (310), and a basin outlet port (334) disposed proximal to the basin bottom (312) on the basin side wall (314), wherein the basin (300) is constructed from a pliable material having a basin inner wall (340), a basin outer wall (342), and a basin sealed cavity (344) disposed between the basin inner wall (340) and the basin outer wall (342), wherein the basin sealed cavity (344) is for inflation, wherein the basin (300) further comprises a basin air port (350) disposed on the basin outer wall (342) for inflation, wherein the basin air port (350) is fluidly connected to the basin sealed cavity (344), wherein in a first state, upon inflation, the basin (300) is for containing water (120), wherein in a second state, upon deflation, the basin (300) is collapsible for easy portability, wherein the spigot (500) is disposed on the basin top (310) for dispensing water (120), wherein water (120) can enter the basin (300) via the basin inlet port (330), wherein water (120) can be removed from the basin cavity (320) via the basin outlet port (334), wherein the inflatable basin system (150) is for providing water (120) for sanitation in areas wherein there is no present or there is limited/remote access like in parks and disaster shelters.

* * * * *